US005160347A

United States Patent [19]

Kay et al.

[11] Patent Number: 5,160,347

[45] Date of Patent: Nov. 3, 1992

[54] MULTICOLORED PIECE-DYED RUGS

[75] Inventors: Mark L. Kay, Villanova, Pa.; Rodger D. Loveless, Wilmar; Bobby Vinson, Rison, both of Ark.

[73] Assignee: Burlington Industries, Inc., Greensboro, N.C.

[21] Appl. No.: 815,913

[22] Filed: Jan. 2, 1992

Related U.S. Application Data

[63] Continuation of Ser. No. 593,210, Oct. 5, 1990, abandoned.

[51] Int. Cl.[5] ..... D06P 3/82; D06P 5/00

[52] U.S. Cl. ..... 8/481; 8/478; 8/480; 8/529; 8/539; 8/654; 8/657; 8/680; 8/922; 8/924; 8/929

[58] Field of Search ..... 8/481, 483, 539

[56] References Cited

U.S. PATENT DOCUMENTS

| | | | |
|---|---|---|---|
| 3,018,272 | 1/1962 | Griffing et al. | 8/512 |
| 3,335,478 | 8/1967 | Eskridge et al. | 28/159 |
| 3,385,831 | 5/1968 | Watson | 528/305 |
| 3,534,540 | 10/1970 | Collingwood et al. | 57/239 |
| 4,196,241 | 4/1980 | van Anholt et al. | 428/92 |
| 4,216,735 | 8/1980 | McDaniel | 8/483 |

OTHER PUBLICATIONS

Anonymous, 17913-Research Disclosure Mar. 1979.

*Primary Examiner*—A. Lionel Clingman
*Attorney, Agent, or Firm*—Nixon & Vanderhye

[57] ABSTRACT

Carrier dyeable polyester yarns are space dyed by spraying with water dispersions of disperse dyes without thickeners or carriers followed by a short steaming process and autoclaving to develop the dyes or by a knit-de-knit process of knitting the yarn into socks or tubes which are roller printed with disperse dyestuff, thickener and carrier dissolved in water in various colors followed by steaming, washing, drying and deknitting. The thus produced space dyed yarns are then tufted into area rugs along with undyed yarns of "carrierless" polyester fibers and/or nylon fibers and dyed with a cationic, acid or disperse dye appropriate to the dye receptivity of the undyed yarns while avoiding overdyeing of the space dyed yarns to produce a multicolor piece-dyed area rug.

2 Claims, 1 Drawing Sheet

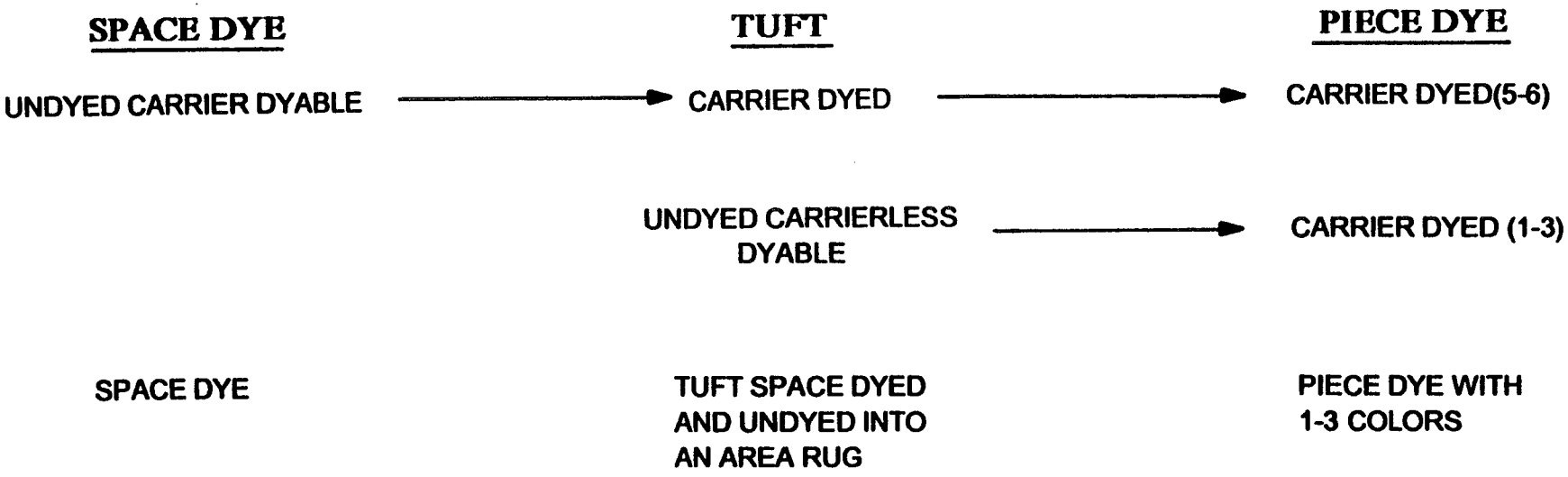
SPACE DYE
UNDYED CARRIER DYABLE
SPACE DYE
TUFT
CARRIER DYED
UNDYED CARRIERLESS DYABLE
TUFT SPACE DYED AND UNDYED INTO AN AREA RUG
PIECE DYE
CARRIER DYED(5-6)
CARRIER DYED (1-3)
PIECE DYE WITH 1-3 COLORS

MULTICOLORED PIECE-DYED RUGS

This is a continuation of application Ser. No. 07/593,210, filed Oct. 5, 1990, now abandoned.

This invention relates to procedures for preparing piece-dyed multicolored rugs, especially area rugs, from synthetic fibers.

BACKGROUND OF THE INVENTION

Industry styling changes have followed consumer demand for more interesting designs and styles. Multicolored rugs currently available are limited to three colors produced by piece-dyeing using yarns of different dye receptivity types to achieve the coloration desired. Commercial and styling demands beyond three colors makes it desirable to provide a multitude of colorations in a given rug product.

Our process of preparing multicolored rugs begins with the use of an initial dyed yarn that is dyed in a multitude of colors, then using the thus dyed yarn and tufting it with undyed yarn of different dye affinity followed by overdyeing to achieve additional colorations. Initial dyeing is accomplished using the space dyeing or intermittent dyeing technique in which the yarn within a given area or space is dyed a particular color, the color and spaces varying throughout the length of the yarn according to random or predetermined orders.

Dyeing carpet yarn is described in U.S. Pat. No. 4,206,735 which relates to a carpet prepared by space dyeing a polyester or polypropylene yarn then tufting the space dyed yarn with another yarn, undyed and having a susceptibility to a dye to which the polyester or polypropylene space dyeing yarn is not susceptible, followed by dyeing the undyed yarn taking care that the selective dyeability of the undyed yarn does not interfere with the previously space dyed yarn. Tak dyeing is used to provide coloration for the nylon tufts and Tak dyeing is explained in U.S. Pat. No. 4,146,362.

Another type of space dyeing is described in U.S. Pat. No. 4,033,717 to Whitaker in which a continuous filament yarn is knit into a prefabric such as a tube or a sock, selectively dyed in a predetermined pattern using various colors, then deknitted, wound onto cones and heated to develop the color. This is also known as a knit/de-knit process. When tufted into a carpet, the tufts of the space dyed yarn are arranged randomly or preferably in predetermined blocks or areas.

Research Disclosure 17913 (Mar. 1979) uses the space dyed yarns of the Whitaker patent, combines them with undyed yarns, then overdyes to a different color to provide a carpet having different color combinations. Space dyed yarns may also be prepared using "resist" techniques to treat the fabric to "resist" the type of dye employed, as described in Jilla, U.S. Pat. No. 3,989,453.

Piece dyeing carpets using carpet pile made from two or more different classes of yarns, one yarn being susceptible to one type of dyeing and the other class of yarns susceptible to a different type of dye, is described in U.S. Pat. No. 3,439,999.

Previously described techniques such as those referred to above were insufficient in retaining the space-dyed coloration of the yarn in the piece-dyed process without the space-dyed coloration bleeding off into the dyebath used for piece dyeing. Also, it was difficult if not impossible to prevent the space dyed yarn itself from being dyed by either the cationic, acid or disperse dyestuffs in the piece dyeing dyebath.

BRIEF DESCRIPTION OF THE DRAWING

FIG. 1 is a flow chart showing the operational sequencing of space dyeing, then tufting followed by piece dyeing. Carrier dyable and carrierless dyable yarns and their condition, dyed or undyed, are indicated throughout the operational steps and each step is further explained under the relevant topical heading.

We have found and hereby disclose a procedure for making the space-dyed yarn impervious to the treatments of the subsequent piece-dyed process and thereby achieving a multicolored tufted rug or carpet product.

Rugs produced by our invention are constructed of synthetic fibers having varying dye affinity and susceptibility to different dyeing procedures. Selectivity among the fibers used affords different colors in the finished goods, together with control over dye bleeding and overdyeing, to enable selective coloration of the several fiber types.

By way of background, it is useful to describe available fibers, especially polyester, using terms by which these materials are recognized in the trade. Carrier polyester fiber requires dyeing with a catalyst, generally called a "carrier", or at very high temperatures and pressures (in the neighborhood of 250° F. at 150 lb/psi). Polyester fiber manufacturers modified the "carrier" fiber polymer content to provide polyester fiber that will accept dyestuffs at lower, more usual dyeing temperatures, generally at the boil, say 210°-212° F., at atmospheric pressure and without the use of carriers. These modified polyesters are called carrierless polyester fibers. For completeness, nylon fibers are by their chemical nature carrierless dyeing fibers and have an affinity or receptivity for either an acid, a cationic or a disperse dye depending on the dye receptivity type of the nylon fiber.

We have found that carrier-type polyester, following space dyeing using either high temperatures and/or a catalyst, is impervious to a carrierless two- or three-color piece-dyeing process in which the previously treated carrier dyed yarns, when introduced into a piece dyeing bath, do not bleed off into the hot dyebath nor is the space dyed coloration dyed by the acid, cationic or disperse dyestuff or combinations of two or three of them used in the piece dyeing operation. Multicolored rugs with as many as 8 to 9 colorations result.

Of the various procedures and techniques available to achieve intermittently or space dyed yarns, we prefer to use a knit-deknit process or selective dyeing using a computer controlled dyeing technique. In the latter, each color is provided by a disperse dye in aqueous solution. The aqueous dye solution is sprayed onto the polyester fibers from individual sprayheads controlled by computer synchronization. This technique allows for minimum wet pickup of the dye liquor and overall accurate control of the process. Thickeners or carriers are not required and are not used. The treated yarn is then steamed at elevated temperatures for approximately ten seconds to form a temporary setting of the dye on and in the fiber to fix the dye to the fiber and to prevent various adjoining different color dyes from wicking together.

The yarn is then wound on cones and subjected to autoclaving to develop the dye. Autoclaving is typically conducted at about 270° F. at a pressure of 27 lb/psi. This is achieved by creating a vacuum in the autoclave then injecting super-heated steam at in excess of 300° F. for thirty minutes. This procedure develops the color and sets the dye. The cones are then air cooled the yarn unwound and is ready for plying or heatsetting or both.

In another preferred space dyeing technique, the carrier dyeable polyester to be dyed is knit into a tube then pad or roller dyed by printing using a mixture of a disperse dye, thickener and carrier dissolved in water. This provides a uniform base shade. Next, disperse dyes are roller printed on the tube in either random or set increments to achieve individual colorations. Again, a print paste composed of disperse dyes, a carrier and a thickener is used. Steaming fixes the disperse dyes into the fiber and fully develops them. Following washing and dyeing in the tube or sock form, the tube is then deknitted into a yarn package and treated to remove the crimp caused in the yarn by knitting.

Tufting of the thus prepared space dyed fibers and undyed carrierless fibers of two or three different dye affinities into an area rug is accomplished using commercially available tufting equipment. The tufted rug is then piece dyed to color the undyed fibers, each dye affinity type preferably being dyed to a different shade.

The space or intermittent dyed yarns previously prepared are tufted together with two or three different types of "carrierless" synthetic fibers. Each type receptive to a corresponding dye type. As an example, acid dyeable nylon filament, cationic-dyeable polyester and disperse dyeable polyester, all three undyed, are tufted together with the space dyed yarn into an area rug. The tufted product is then subjected to piece dyeing using a mixed dyebath containing each of the dye types for which there is a corresponding, dyeable fiber. In the example mentioned, three different dye types or indices, cationic, disperse and acid, are present in the same dyebath.

Illustrative carrier-type polyester fibers include DyPont's Dacron 776 and Hoecht's Trevira 825 and Trevira 828. As the carrierless-type fibers one may consider for the disperse dyes, DuPont Dacron 768 or Hoechst Trevira 816, for the cationic dyes, DuPont 169 or Hoechst Trevira 843 or Trevira 844, and for acid dyeable fibers, the nylon 6,6 based Monsanto 1978 or DuPont 636A, or Allied 840 (type 6 nylon) or BASF N857 or N860.

Piece dyeing is conducted under controlled conditions so that the undyed fibers receive and accept the appropriate dye type while the carrier-dyed fibers, previously space dyed, are not effected by and cannot be dyed by this dyebath. Piece dyeing holds advantages over weaving, knitting or otherwise assembling fabrics or finished goods from predyed yarns and fibers. Piece dyeing brings with it significant savings in reduction of yarn inventories, storage space, reduced cost in tufting, less costly dyeing and reduced finished goods inventory.

The resulting tufted area rugs have three different colors resulting from the piece dyeing operation and even more colors resulting from the space dyeing operation.

What is claimed is:

1. A process of preparing a multicolor piece-dyed rug comprising the successive steps of:

(a) space dyeing a carrier dyeable polyester yarn in the presence of a carrier or using a high temperature dye fixation process optionally in the presence of a carrier;

(b) tufting into an area rug the space dyed yarn of step (a) and three different undyed synthetic yarns, an acid dyeable nylon, a cationic dyeable polyester and a disperse dyeable polyester, which are dyeable absent carrier with an acid, cationic and disperse dye, respectively; and (c) dyeing in a single dyebath the area rug prepared in step (b) with an acid, cationic and disperse dye, respectively, corresponding to the respective dye affinities of the undyed synthetic yarns to dye the undyed synthetic fibers tufted in step (b) into three different colors without dyeing or bleeding the space dyed yarn and producing a multicolor piece-dyed area rug.

2. The process of claim 1, in which the space dyed yarn of step (a) is impervious to overdyeing, bleeding or both.

* * * * *